United States Patent [19]

Anderson

[11] Patent Number: 5,024,033

[45] Date of Patent: Jun. 18, 1991

[54] PREFABRICATED CONSTRUCTION UNIT WITH INSULATION

[76] Inventor: Ray L. Anderson, Box 3031, Langley, British Columbia V3A, 4R3, Canada

[21] Appl. No.: 323,171

[22] Filed: Mar. 15, 1989

Related U.S. Application Data

[63] Continuation of Ser. No. 114,516, Oct. 30, 1987, abandoned.

[51] Int. Cl.[5] ..... E04B 2/46

[52] U.S. Cl. ..... 52/407; 52/456; 52/586; 52/764

[58] Field of Search ..... 52/404, 406, 407, 586, 52/455, 456, 457, 458, 764, 765, 586

[56] References Cited

U.S. PATENT DOCUMENTS

| | | | |
|---|---|---|---|
| 3,300,919 | 1/1967 | Hiller | 52/586 |
| 3,623,288 | 11/1971 | Horowitz | 52/586 |
| 3,979,869 | 9/1976 | Beehler | 52/586 |
| 3,995,402 | 12/1976 | Parenteau | 52/586 |
| 4,512,131 | 4/1984 | Laramore | 52/586 |
| 4,542,614 | 9/1985 | Malachowski | 52/586 |
| 4,567,699 | 2/1986 | McClellan | 52/586 |
| 4,599,841 | 7/1986 | Haid | 52/586 |
| 4,676,038 | 6/1987 | Doyon et al. | 52/586 |

FOREIGN PATENT DOCUMENTS

| | | | |
|---|---|---|---|
| 283101 | 5/1965 | Australia | 52/586 |
| 2362445 | 6/1975 | Fed. Rep. of Germany | 52/586 |
| 1313933 | 11/1962 | France | 52/407 |

*Primary Examiner*—Michael Safavi

*Attorney, Agent, or Firm*—Townsend and Townsend

[57] ABSTRACT

A pre-formed insulated wall construction unit comprising a support framework utilizing spaced, spanning members mounted between upper and lower cross members to form a wall unit having a series of open compartments with opposed side edges defined by the spaced, spanning members and opposed end edges defined by the upper and lower cross members. The open compartments are occupied by rigid insulation with grooves cut about the insulation's edges. The opposed side edges and the opposed end edges of the compartments have an attached sealing strip with a T shaped cross-section, the head of the T being an attachment flange to secure the strip to a framework member, and the leg of the T being an engagement flange formed with flexible angled fingers to seal in the grooves in the rigid insulation in order to hold the insulation securely within each open compartment and seal the edges of the insulation. In a second embodiment, the sealing strip is formed from a rigid plane member sandwiched between two longitudinal members such that the protruding edges of the plane member act as a sealing strip.

10 Claims, 2 Drawing Sheets

PREFABRICATED CONSTRUCTION UNIT WITH INSULATION

This is a continuation division of application Ser. No. 07/114,516 filed Oct. 30, 1987, now abandoned.

This invention relates to a pre-fabricated insulated wall construction unit.

BACKGROUND OF THE INVENTION

Numerous pre-fabricated wall construction units are known in the building industry. Methods of insulating these wall units include pouring shavings between wall studs or inserting fiberglass insulation or rock wool inside the wall framework. The main drawback of the foregoing wall construction units is their high cost and the difficulty of manufacturing the units. As well, the insulation methods employed do not completely seal the walls so that the units are not as energy efficient as possible.

SUMMARY OF THE INVENTION

The present invention is a prefabricated insulated wall comprising a support framework utilizing spaced spanning members mounted between upper and lower cross members to form a wall unit having a series of open compartments with opposed side edges defined by said spaced, spanning members and opposed end edges defined by said upper and lower cross members, said open compartments being occupied by rigid insulation with grooves cut about the insulation's edges, the opposed side edges of said compartments and the opposed end edges of said compartments having an attached sealing strip with a T shaped cross-section, the head of the T being an attachment flange to secure said strip to a framework member, and the leg of the T being an engagement flange formed with flexible angled fingers to seat in said grooves in said rigid insulation in order to hold said insulation securely within said open compartments and seal the edges of said insulation.

The sealing strips of the present invention ensure that the perimeter of each insulation block is completely sealed to create a more effective insulating layer than presently available.

In a further embodiment of the present invention, only the opposed side edges of each compartment are sealed with the rigid insulation block using the sealing strip, the remaining edges of the insulation block being glued directly to the opposed end edges of the compartment.

The present invention makes provisions to accommodate the passage of electrical and plumbing components within the wall construction unit. Spanning members are provided with holes therethrough and the rigid insulation has removable sections to accommodate the passage of electrical and plumbing components within the interior of the construction unit.

DESCRIPTION OF THE DRAWINGS

The present invention is illustrated in the following drawings in which.

DESCRIPTION OF THE PREFERRED EMBODIMENTS

Figure 3:
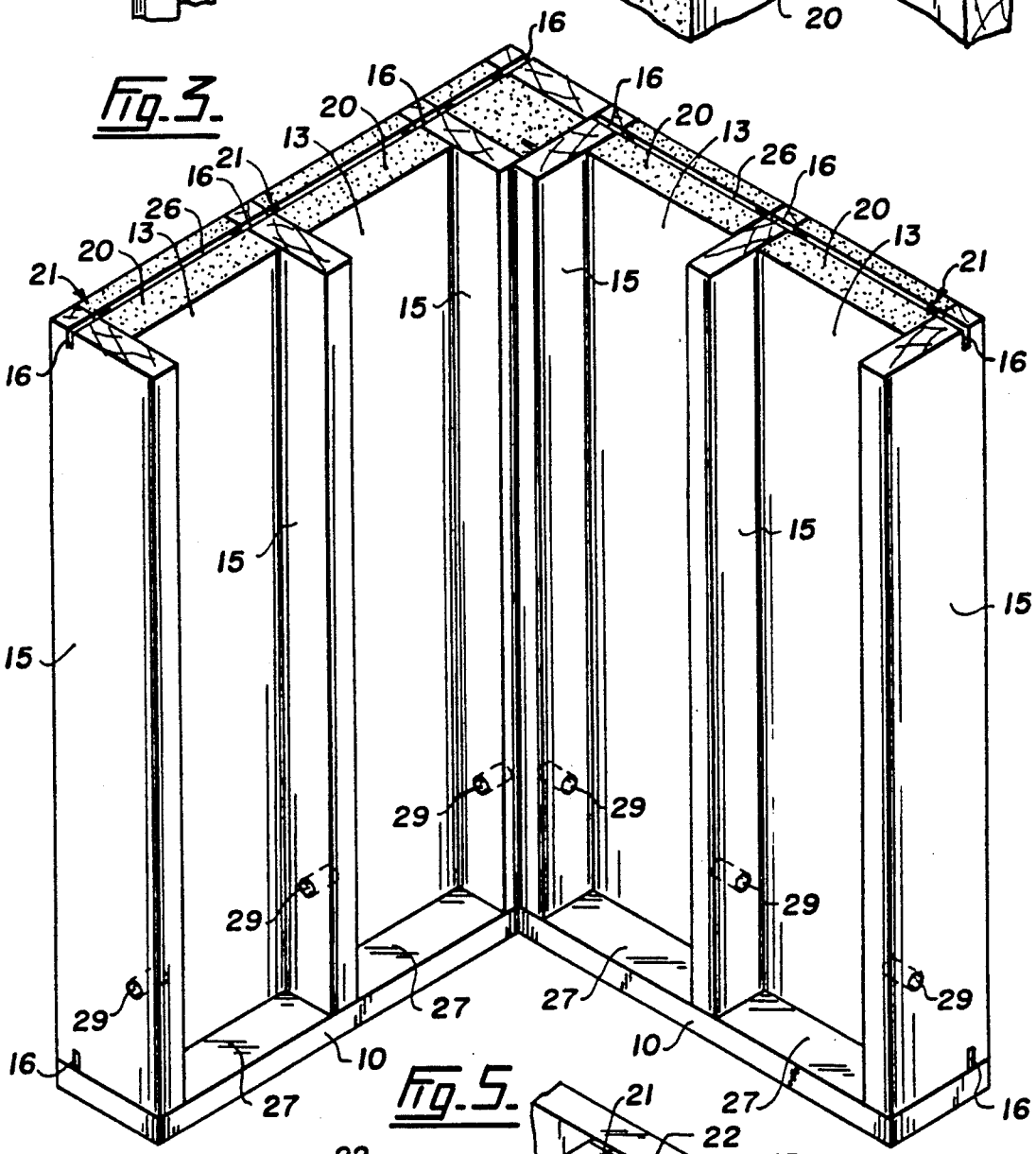
FIG. 3 is a sectioned view showing a wall construction unit according to the present invention.

Referring to FIG. 3, there is shown a pair of wall units constructed according to a preferred embodiment of the present invention and joined at right angles. Spaced vertical spanning members or wall studs 15 extend between horizontal cross members 10 (the upper cross member being omitted in this drawing) to form a wall unit with a series of open compartments 13. Rigid insulation blocks 20 are located in these open compartments between vertical wall studs 15 and cross members 10 by a system of sealing strips 21 which engage grooves 26 formed in the edges of the insulation blocks. Preferably, rigid insulation blocks 20 are formed from expanded polystyrene and structural members 10 and 15 are made from wood.

Figure 1:
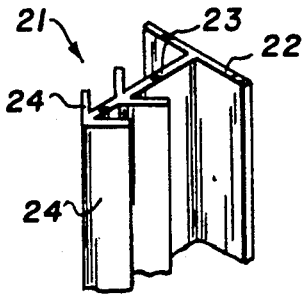
FIG. 1 is a pictorial view of a preferred embodiment of a sealing strip according to the present invention.
Figure 2:
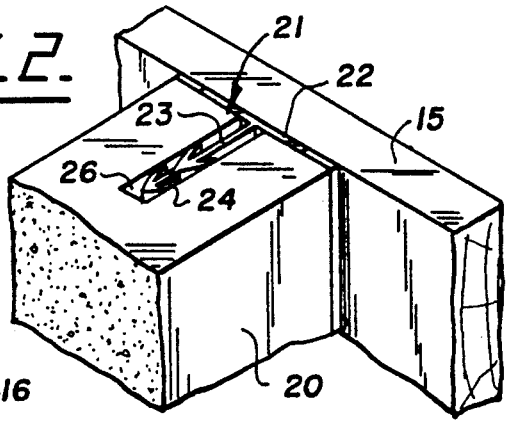
FIG. 2 is a sectioned viewed showing the sealing strip of FIG. 1 in use.

A detailed view of a preferred embodiment of a sealing strip is shown in FIG. 1, the sealing strip comprising a flexible strip having a T shaped cross section. The head of the T is used as an attachment flange 22 to connect the sealing strip to the inside edge of a stud member 15 as shown in FIG. 2. Extending at right angles from attachment flange 22 is engagement flange 23 which is formed with paired flexible fingers 24 angled rearwardly toward attachment flange 22 and forming an acute angle with the surface of engagement flange 23. As shown in FIG. 2, fingers 24 are inserted in pre-cut groove 26 in a rigid insulation block 20. Groove 26 is dimensioned to be sufficiently narrow to compress fingers 24 between the walls of the groove to create a tight friction grip between the sealing strip 21 and the insulation block 20.

Figure 4:
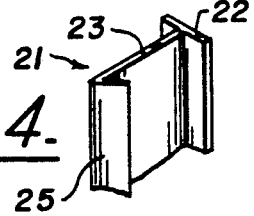
FIG. 4 is a pictorial view showing another embodiment of a sealing strip.
Figure 5:
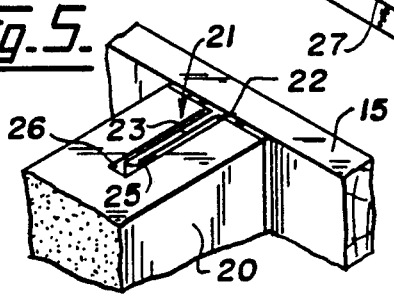
FIG. 5 is a sectioned view showing the sealing strip of FIG. 4 in use.

In another embodiment of the present invention, a modified sealing strip as shown in FIG. 4 can be used. This strip also has a T shaped cross section with attachment flange 22 and perpendicular engagement flange 23. However, engagement flange 23 is formed with a single angled finger 25. As shown in FIG. 5, fingers 25 and engagement flange 23 are inserted in pre-cut groove 26 in a rigid insulation unit 20 where the finger is compressed against the walls of the groove to create a tight friction grip between the sealing strip and the insulation unit.

Figure 10:
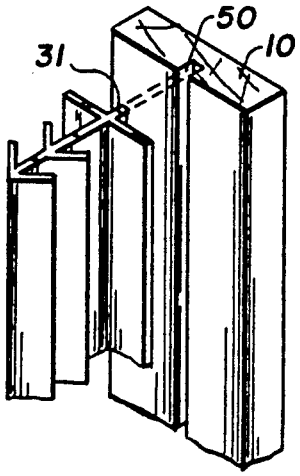
FIG. 10 shows a further embodiment of the sealing strip of the present invention.

In a still further embodiment of the present invention, a modified sealing strip as shown in FIG. 10 can be used. This embodiment includes the addition of a locating tab 31 formed on the rear face of attachment flange 22 and extending perpendicularly to the face. When such a sealing strip is used, a groove 50 is cut along the length of spanning members 15 and cross members 10. Locating tab 31 fits within this groove when sealing strip 21 is attached to a member and provides additional anchor support for the sealing strip.

In the preferred embodiment of the present invention illustrated in FIG. 3, sealing strips 21 extend about the entire perimeter of each rigid insulation block 20 in order to seal each compartment 13 of the wall unit. Sealing strips 21 are made from suitable flexible material such as rubber or vinyl to allow for expansion and contraction of the entire wall unit without breaking the seal about the insulation block. Notch 16 is made in the top and bottom of each vertical wall stud 15. Notch 16 aligns with groove 26 formed about each rigid insulation block 20 and is sufficiently deep that it will receive the sealing strip mounted to upper and lower cross members 10.

In a further embodiment of the present invention, sealing strips 21 are only attached to vertical wall studs 15 and engage grooves in the corresponding edges of the rigid insulation blocks 20. The upper and lower ends of the insulation blocks 20 are bonded directly to the upper and lower cross members 10 using a silicon type sealant.

Figure 8:
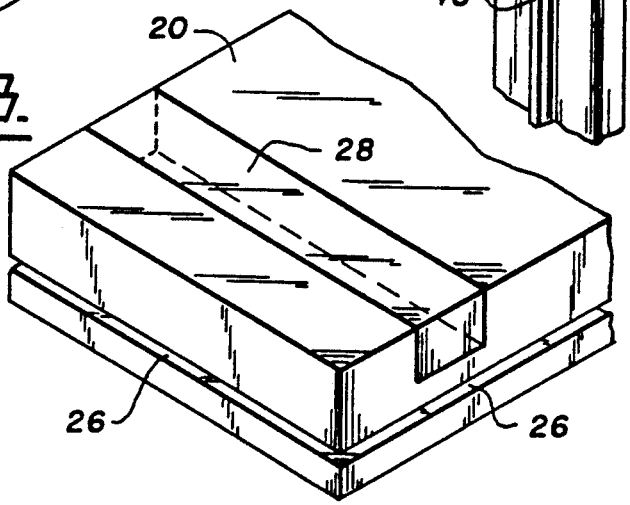
FIG. 8 shows a block of rigid insulation with edge grooves ready for assembly.

As shown in FIG. 3, rigid insulation blocks 20 do not have to extend across the width of the wall unit. Indeed, air space 27 between insulation block 20 and a finishing surface (not shown) acts as an additional insulating layer. In the event that rigid insulation blocks 20 do fill compartment 13 entirely, removable pre-cut plugs 28, as shown in FIG. 8, can be formed in the rigid insulation blocks. Plugs 28 can be taken out as necessary to provide space within the interior of the wall construction unit for the passage of plumbing lines or electrical conduits. As shown in FIG. 3, holes 29 through vertical studs 15 are also provided to allow plumbing and electrical components to pass from compartment to compartment. Preferably, holes 29 will align with plugs 28.

Figure 9:
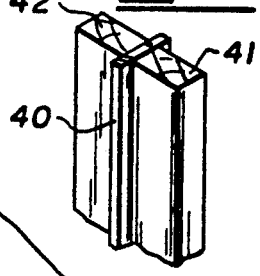
FIG. 9 shows a further embodiment of the present invention.

A further embodiment of the present invention which does not use the flexible sealing strips of the previous embodiments is shown in FIG. 9. Structural members 10 and 15 are replaced by two longitudinal members 41 and 42. Flexible sealing strips 21 are replaced by thin sheet 40 which is sandwiched between members 41 and 42 to create a member having rigid sealing strips extending perpendicularly to members 41 and 42. If only a single sealing strip is required down one side of a member, one protruding edge of thin sheet 40 can be removed. Ideally, thin sheet 40 comprises a suitably dimensioned sheet of plywood.

Figure 7:
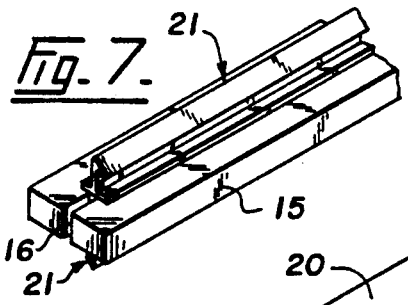
FIG. 7 shows a structural member with an applied sealing strip ready for assembly.

By way of example, the following description details the construction procedure used to assemble the preferred embodiment of the present invention shown in FIG. 3. As shown in FIG. 7, sealing strips 21 are attached along the length of each side of spanning member 15. The two end spanning members of the wall unit will only have a single sealing strip attached along the inner edge. Upper and lower cross members 10 will also have a sealing strip attached along one edge. The sealing strips may be glued in place or they may be stapled through the attachment flange 22. Spanning members 15 are passed through a saw unit to cut notches 16 in the upper and lower ends of the member. As well, rigid insulation units 20 need to be prepared as shown in FIG. 8. This is done by cutting standard blocks of expanded polystyrene insulation into units that will fit between the stud members of the wall unit. Such an operation can be performed by passing the insulation blocks through a cutting chamber having a bank of hot wire cutting elements to cut the blocks into the necessary insulation units 20. The units 20 are grooved about each edge of the unit by passing them through a set of double saw blades to produce a insulation unit as shown in FIG. 8.

Figure 6:
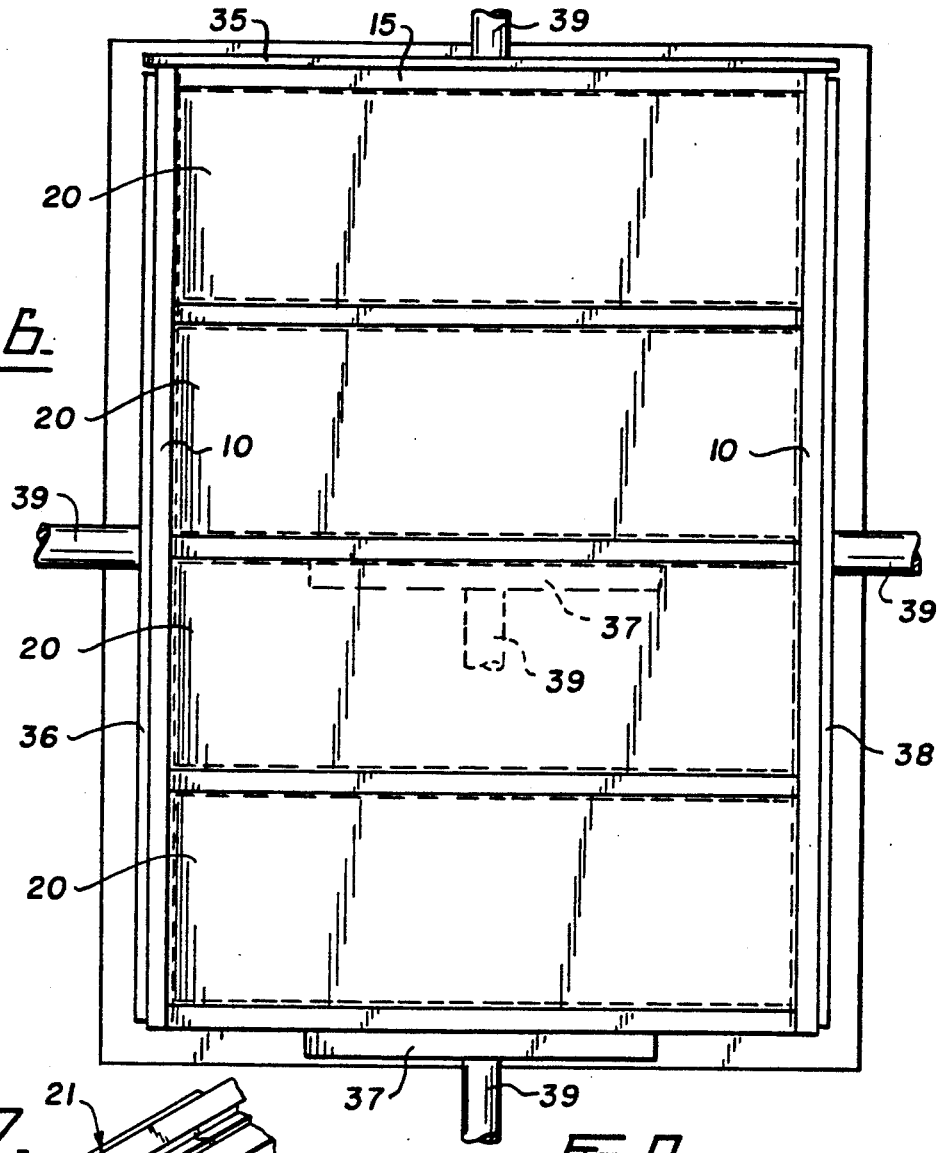
FIG. 6 shows the apparatus used to construct a wall unit according to the present invention.

The present wall construction unit is assembled on a table 30 as shown in FIG. 6, the table having hydraulically controlled plates 35, 36, 37 and 38 about each edge of the table actuated by piston arms 39. Alternatively, plates 35, 36, 37 and 38 may be manually operated using screw threads. The plates act to position and hold structural members of the wall unit as it is constructed. A first end spanning member 15 with a single sealing strip along one edge is placed against plate 35, the edge of the member having sealing strip 21 attached facing away from the plate 35. Plates 36 and 38 are positioned to hold the ends of the spanning member. An insulation block 20 as shown in FIG. 8 is then placed beside the spanning member 15 between plates 36 and 38 such that a groove 26 is aligned with the sealing strip 21. Plate 37 is then moved to compress sealing strip 21 into groove 26 of insulation block 20. Plate 37 is withdrawn and a spanning member with both edges provided with sealing strips is placed between plates 36 and 38. Plate 37 is then used to compress the second spanning member onto the insulation block. This process is continued alternating spanning members and insulation blocks until the desired length of wall unit is completed. Plates 35 and 37 are then used to clamp the unit in place. Plates 36 and 38 are moved outwardly and upper and lower cross members 10 are inserted between plates 35 and 37. Plates 36 and 38 are then moved inwardly to compress the sealing strips of the upper and lower cross members into the grooves of the insulation blocks. The clamping plates are withdrawn and the cross members and spanning members nailed or screwed together to create a pre-fabricated insulated modular wall unit.

Such a unit is ideal for residential, agricultural or commercial constructions. The wall unit of the present invention incorporates rigid insulation between structural members with an air tight seal about the perimeter of the insulation to improve the insulating capabilities of the wall unit as compared to conventional insulated walls.

I claim:

1. A pre-formed insulated wall construction unit comprising:

a support framework utilizing spaced spanning members mounted between upper and lower cross members to form a wall unit having a series of open compartments with first and second pairs of opposed edges defined by said spaced, spanning members and said upper and lower cross members, respectively, said open compartments being occupied by rigid insulation having grooved edges, sealing strips with a T shaped cross-section attached to said first pair of opposed edges of said compartment, the head of the T being an attachment flange to secure said strip to a framework member, and the leg of the T being an engagement flange formed with a single angled flexible finger at an acute angle to the plane of the engagement flange to seat in said grooves in said rigid insulation in order to hold said insulation securely within said open compartments, said second pair of opposed edges being bonded directly to the adjacent edges of said rigid insulation.

2. A construction unit as claimed in claim 1 in which said sealing strips are stapled through said attachment flange to said structural members.

3. A construction unit as claimed in claim 1 in which said sealing strips are glued to said structural members by said attachment flange.

4. A construction unit as claimed in claim 1 in which said sealing strips are made from vinyl.

5. A construction unit as claimed in claim 1 in which said sealing strips are made from rubber.

6. A construction unit as claimed in claim 1 in which said rigid insulation is formed from blocks of expanded polystyrene.

7. A construction unit as claimed in claim 6 in which said rigid insulation has removable portions to accommodate the passage of plumbing and electrical components within the interior of the compartments of the construction unit.

8. A construction unit as claimed in claim 1 in which said spaced, spanning members have holes drilled therethrough to accommodate the passage of plumbing and electrical components from compartment to compartment.

9. A construction unit as claimed in claim 1 in which said support framework is constructed from spaced, parallel spanning members mounted perpendicularly between a pair of parallel cross members to define a rectangular wall unit.

10. A construction unit as claimed in claim 1 in which said spanning members and said cross members are made from wood.

* * * * *